US010845041B2

(12) United States Patent
Pena et al.

(10) Patent No.: US 10,845,041 B2
(45) Date of Patent: Nov. 24, 2020

(54) LINEAR LIGHT FIXTURE WITH PIVOTABLE LIGHT ELEMENT

(71) Applicant: New Star Lighting, LLC., Chicago, IL (US)

(72) Inventors: John Pena, Chicago, IL (US); Pawel Kwak, Chicago, IL (US); Daniel P. Slabek, Chicago, IL (US)

(73) Assignee: New Star Lighting, LLC., Chicago, IL (US)

( * ) Notice: Subject to any disclaimer, the term of this patent is extended or adjusted under 35 U.S.C. 154(b) by 0 days.

(21) Appl. No.: 16/655,445

(22) Filed: Oct. 17, 2019

(65) Prior Publication Data

US 2020/0124260 A1 Apr. 23, 2020

Related U.S. Application Data

(60) Provisional application No. 62/746,749, filed on Oct. 17, 2018.

(51) Int. Cl.

| | |
|---|---|
| ***F21S 8/04*** | (2006.01) |
| ***F21V 21/30*** | (2006.01) |
| ***F21V 14/02*** | (2006.01) |
| ***F21S 8/02*** | (2006.01) |
| ***F21V 17/10*** | (2006.01) |
| ***F21V 21/15*** | (2006.01) |

(Continued)

(52) U.S. Cl.

CPC ..... *F21V 21/30* (2013.01); *F21S 8/026* (2013.01); *F21S 8/04* (2013.01); *F21V 14/02* (2013.01); *F21V 17/10* (2013.01); *F21V 21/15* (2013.01); *F21W 2131/10* (2013.01); *F21Y 2103/10* (2016.08); *F21Y 2115/10* (2016.08)

(58) Field of Classification Search

CPC .. F21S 8/026; F21S 8/04; F21V 14/02; F21V 17/10; F21V 21/15; F21V 21/30; F21W 2131/10; F21Y 2103/10; F21Y 2115/10

See application file for complete search history.

(56) References Cited

U.S. PATENT DOCUMENTS 2,740,885 A * 4/1956 Kruger ..... F21V 17/02 362/220

3,702,928 A * 11/1972 Alger ..... A61C 19/00 362/33

(Continued)

*Primary Examiner* — Zheng Song

(74) *Attorney, Agent, or Firm* — Dennemeyer & Associates, LLC

(57) ABSTRACT

An extended length or linear type light fixture having a lighting element placed on pivoting members locked into the fixture is provided. The fixture is of the typical sealed beam fixture used in outdoor or places having an environment harmful to electronics. The present invention allows the fixture to be installed, often at elevated positions, relative to the ground, or in places not easily accessible, and allows the light element to be pivoted so that even after the light fixture is installed, the light from the fixture can be pivoted to project light where more desired. As such the installation of lighting fixtures is simplified and adjustments are possible even after installation and upon the change of conditions and as needed for immediate change and restoration. The fixture provides a high grade light element with easy adjustments for use in a variety of situations that previously required removal and reinstallation of light fixtures or the use of additional fixtures at increased costs.

18 Claims, 9 Drawing Sheets

(51) Int. Cl.
*F21Y 103/10* (2016.01)
*F21Y 115/10* (2016.01)
*F21W 131/10* (2006.01)

(56) References Cited

U.S. PATENT DOCUMENTS 4,164,784 A * 8/1979 Jaksich ..... F21S 6/002 362/282
4,654,757 A * 3/1987 Birkhauser ..... B60Q 1/302 362/287
5,291,381 A * 3/1994 Price ..... F21V 21/04 248/291.1
6,036,337 A * 3/2000 Belfer ..... F21S 8/02 362/257
6,517,216 B1 * 2/2003 Cercone ..... F21S 8/026 362/220
7,712,926 B2 * 5/2010 Matheson ..... F21V 29/004 362/294
8,201,974 B1 * 6/2012 Smith ..... F21V 21/30 362/257
8,858,028 B2 * 10/2014 Kim ..... F21S 2/005 362/249.02
9,004,728 B2 * 4/2015 Thompson ..... F21V 21/14 362/371
2001/0012205 A1 * 8/2001 Lassovsky ..... F21S 8/026 362/282
2009/0290340 A1 * 11/2009 Hayakawa ..... F21S 8/026 362/235
2011/0051410 A1 * 3/2011 Liang ..... F21S 8/02 362/235
2013/0051059 A1 * 2/2013 Abai ..... F21S 45/47 362/240
2013/0194791 A1 * 8/2013 Cercone ..... F21S 8/046 362/220
2013/0329413 A1 * 12/2013 Cotta, Sr. ..... B60Q 1/0483 362/220
2018/0073705 A1 * 3/2018 Delano ..... F21V 7/00

* cited by examiner

LINEAR LIGHT FIXTURE WITH PIVOTABLE LIGHT ELEMENT

FIELD OF THE INVENTION

The present invention concerns light fixtures. More particularly the present invention concerns a mountable light fixture where the light element comprises an elongated light projector to provide a sufficient coverage of light, rather than a spot light, the light projector can be aimed to provide a desirable amount of light where needed. The fixture permits the light to be aimed at a first location and then adjusted to another location without the need, as in the prior art, to detach the fixture, provide appropriate electrical connection and reattach it so as to aim the light better.

BACKGROUND OF THE INVENTION

While there are many types of lighting fixtures available from many manufacturers and for many purposes, the present invention is directed to those types of fixtures that can be used inside buildings as well as outside, placed high above a floor, attached to walls or other structures in a fixed manner, and which can provide an elongated light element that provides full coverage, as opposed to spot lighting, and is a directional source of light to securely light and fully light an area. While elongated lighting fixtures are extant from many manufacturers, they are exclusively unidirectional in the placement of their light, such that once placed in a location, the light element is focused to a single place or location and cannot be refocused without removing the fixture and placing it elsewhere or at a different pitch in the same location, so that its light can project to a different location. Such movement of existing light fixtures typically requires the attention of an electrician to provide electrical connections for the fixture, first in one location and then, later, moving the connection to the fixtures new location. There is additionally, the situation where a fixture is first placed in one location and it is found to not project onto its directed location properly, requiring a move to a new location, or adjustment in its present location—either of which can be time consuming, costly and require damage to the wall, or other surface, onto which the fixture is placed. Such a move, therefore, is not inexpensive requiring planning, infrastructure and execution and is often not done when moving a fixture would only slightly alter the focus of the light. As such, those truly requiring light in another location may simply suffer with indirect illumination, causing safety and health issues, rather than go to the trouble and expense of having the fixture relocated.

Further, it is rare that upon the fixing of a light fixture in one location, that the exact area to be illuminated is covered by a fixture. Typically installers will use a number of fixtures so as to be sure to cover an area completely at the added costs of more fixtures, installation plus the added costs of electricity to run all of those fixtures.

Existing lights, of the type described above, project light perpendicularly to the unit, that is, light is emitted out from the light box such that the box must be placed so that light projects in a straight plane away from the element. As such, when placing the fixture, it must be determined at that time the direction that the light will be projected. If the light box is placed such that light does not shine where desired, the fixture must be removed and replaced, sometimes with the addition of shims or other elements to allow the light to be projected where desired. Typically, spot lights, which can be pointed as desired, do not provide the quality and amount of light needed in many situations; such lights do not provide the necessary lumens at the illumination zone, to offer sufficient light for the desired use. Additionally, light from fixtures that can be adjusted often causes uncomfortable illumination, blinding in one area and insufficient coverage in others. The use of multiple fixtures in such places is costly, requires overlap between fixtures which is wasteful of electricity and bulbs and typically causes the wasting of lumen power, due to overlap and over-brightness in areas of coverage.

In outdoor situations, where accessibility and mounting can prove to be problems it would be desirable to have an elongated bar-type fixture that can be mounted once and then adjusted to provide light where desired, while still maintain the security of the light element within a protected fixture. Existing outdoor lighting is typically fixed in a single location such that the light projects where desired and if or when light needs to be projected elsewhere, the fixture must be detached and re-attached so as to project the emitted light where desired. It would be desirable to have a fixture capable of surviving conditions in the open, outdoors, and have the capability of being adjustable to project light where desired after fixing the light's casing in a safe and secure location. It is important that a fixture so placed give an appearance of quality and thoughtful placement and not give an impression that it has been haphazardly installed or shimmed to project to a particular location. Further, the ability to move the position of the light and then quickly return it to its original location would be desirable as well.

Other objects and advantages of the present invention will become apparent as the description proceeds.

SUMMARY OF THE INVENTION

In accordance with the present invention, a light fixture, for providing secure targeted lighting, is provided, comprising a housing for mounting, such as on a building or other structure. The housing of the fixture defines an axis between a right side housing panel and a left side housing panel of the fixture. The fixture includes, in a preferred embodiment, a bottom panel, for attachment to the housing, the bottom panel defines an opening therewithin; the opening being framed within the bottom panel. Adjacent the bottom panel of the light fixture, a light element is pivotably attached, within the housing, at least parallel to the axis defined therein, such that the light element rests within the housing and so that light projects through the opening in the bottom panel when the light element is turned on. The light element is pivotable relative to the axis of the housing, in a preferred embodiment, in a range of about 50 degrees, such that the light element can be aimed, in that range, as desired to direct the light and can subsequently be aimed to direct the light elsewhere within the range.

In a preferred embodiment, the light element comprises LED lamps. The light element is pivoted on threaded bolts placed at an axis of the light fixture and the threaded bolts are capped with spacing means and cooperatively threaded nuts to allow the light element to rotate about the axis of the housing. In one use of the invention the threaded nuts are tightened onto the threaded bolts after the light element is pivoted to a desired position, so as to lock the light element at that location. In another embodiment, the light fixture includes a central locking pin and one or more detent opening, the detent openings are spaced in an arc corresponding with the pivoting of the lamp. In one embodiment, the detent openings are spaced so as to divide the arc into 4 positions plus the neutral position (the lamp pointing directly down). The locking pin and one or more detent openings cooperates so that the locking pin can secure the angle of the lamp along the arc after the light element is pivoted to a desired position and the locking pin is placed in one of the one or more detent openings, thereby locking the light element at that location.

In another embodiment, the fixture includes a motive means comprising at least a motor and a transmission to remotely control the pivoting of the light element. Additionally, the fixture can including a remote control to activate and control the motive means. It will be understood that the remote control can be wired or wireless. In some embodiments, the light fixture has means, including one or more of a timer, programming and a solar detector, to cause the motive means to pivot the light element as desired, programmed or needed.

In many embodiments, the light element of the fixture is provided with a lens to protect the interior and focus light emitted from the light element and in some embodiments, the lighting fixture is sealed for exterior use.

In a preferred embodiment, a light fixture for providing secure targeted lighting, is provided comprising a housing for mounting on a building or structure, the housing comprising a generally rectangular top a front side panel, a left side panel and a right side panel, each depending therefrom, the bottom and back of the housing being open, the housing further defining an axis between the right side panel and the left side panel of the housing. A back panel is provided, having a front side and a rear side, the rear side being mounted, to a structure or other elevated location and at its front side being cooperative for attachment to the housing. The fixture further includes a bottom panel, for attachment to the housing, the bottom panel having an opening therewithin, the opening being framed within the bottom panel.

A light element is pivotably attached within the housing, at least parallel to the axis defined therein, such that the light element rests, within the housing, and that light projects through the opening in the bottom panel when the light is on. The light element is pivotable, relative to the axis of the housing, in a number of ranges, including a range of 50 degrees, a range of about 90 degrees and a range of 180 degrees, such that the light element can be aimed, in that range, as desired to direct the light and can subsequently be aimed to direct the light elsewhere within the range. It will be understood that the connection and pivoting of the light element in the present embodiment mirrors that described in other embodiments described herein and above.

In some embodiments the degree of rotation of the light element is 180 degrees, such that the light element can be rotated into an interior of the housing to more completely protect the fixture, and specifically the light element, from damage. In a preferred embodiment, the fixture includes a motive means comprising at least a motor and a transmission to remotely control the pivoting of the light element and can include a remote control to activate and control the motive means. Additionally, the light fixture of the present embodiment can include one or more of a timer, programming and a solar detector, to cause the motive means to pivot the light element.

BRIEF REVIEW OF INVENTION

Building codes stipulate that most buildings require a means of egress system to safely evacuate occupants. Egress lighting presents a tough challenge in that each building or entryway is different, and thus needs a different level or throw of light. Currently in the market, above the door egress luminaires are static and can only provide one throw of light. The present invention was made to bring a durable, high-performing luminaire to the egress market that can be adjusted to suit a variety of buildings and entryways and other locations. The rotatable optic chamber inside the device allows for various positions of light along one axis to suit a variety of applications.

Multiple piece components combine to create an optical chamber with 2 bolts on each end that allow rotation along one axis. The chamber can be rotated freely or with the locking mechanism for a fixed position. High impact LED's are inside the optical chamber shielded by a diffuser for maximum light output. The present invention then provides a rotatable optic chamber that allows for the area of light distribution to be adjusted in the field to suit a variety of egress building applications and conditions. With the present invention, a specific light throw can be achieved based on preference or building codes. The rotatable mechanism can produce varying degrees of forward throw or positioned toward the inside of the doorway, shelter or wall.

DETAILED DESCRIPTION OF THE ILLUSTRATIVE EMBODIMENT

Figure 1:
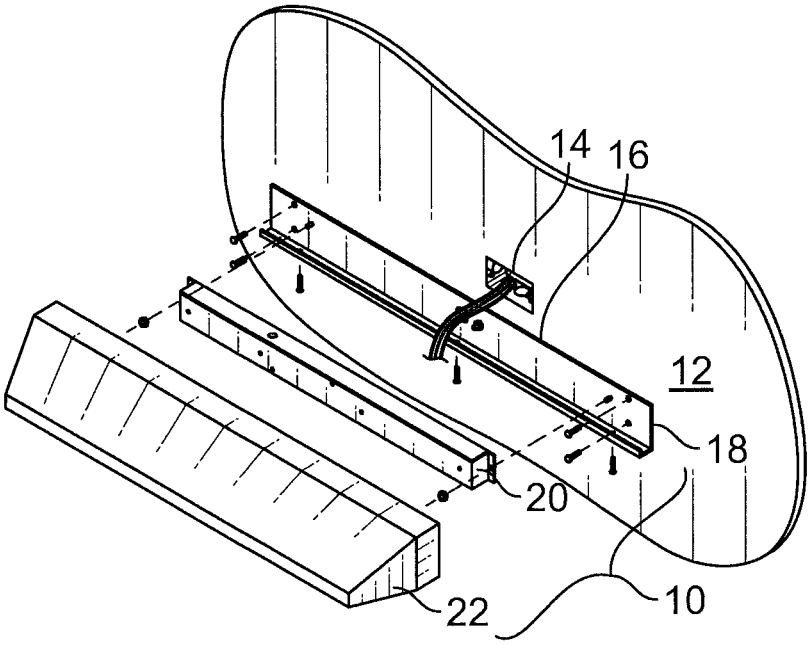
FIG. 1 is an exploded perspective view of a light fixture made in accordance with the prior art, in place on a wall.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring now to the figures, a lamp assembly 10 of the prior art is shown in an exploded view adjacent to a mounting surface 12. It will be seen that an opening 14 must be made in the surface 12 and wiring 16 must be placed within and through surface 12 so as to electrify the lamp 10. It will be understood by persons having ordinary skill in the art that the creation of the opening 14 and the threading of the wiring 16 by skilled workers, at great costs, must be made in the correct place for permanent installation of the lamp 10. If the opening 14 is made and the wiring 16 is placed and then the lamp 10 is installed but provides light to an incorrect location, the effort will need to be repeated to place the lamp 10 correctly to light the area desired. Such would not only include a duplication of effort but the need to repair the damage caused by the incorrect opening and the need to place the wiring again—using skilled workers.

The lamp 10 of FIG. 1 is shown to include a mounting plate 18, a wiring cover 20 and a lamp housing 22; all of which must be installed and assembled together. Such lamp assembly 10 will, as is known to persons having ordinary skill in the art, result in a lamp fixture 10 having a fixed lighting area thrown down from the lamp 10, as installed, typically to an area directly beneath the lamp 10.

Figure 2:
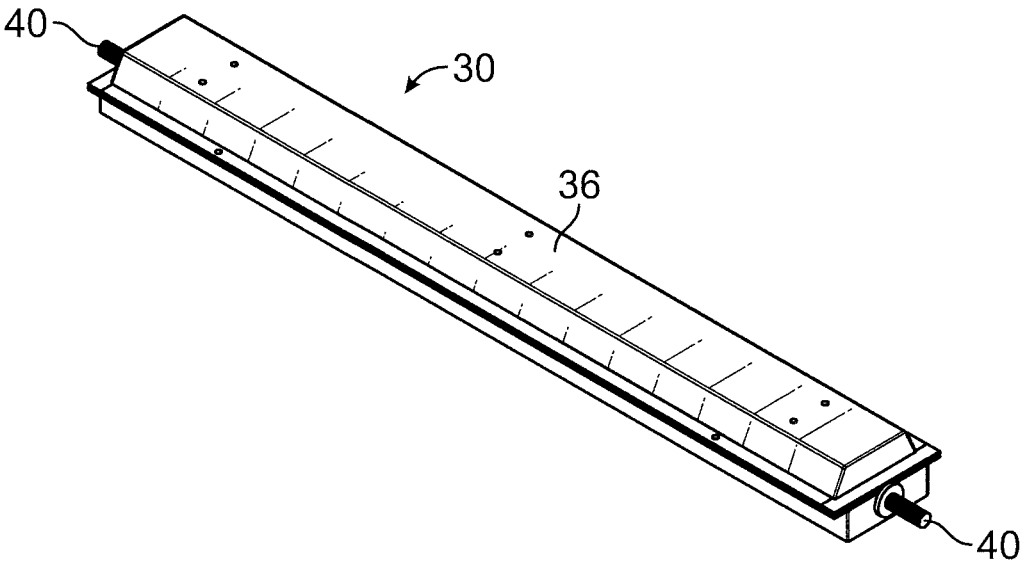
FIG. 2 is a top perspective view of the optical chamber, or light box, of a fixture made in accordance with the present invention.
Figure 3:
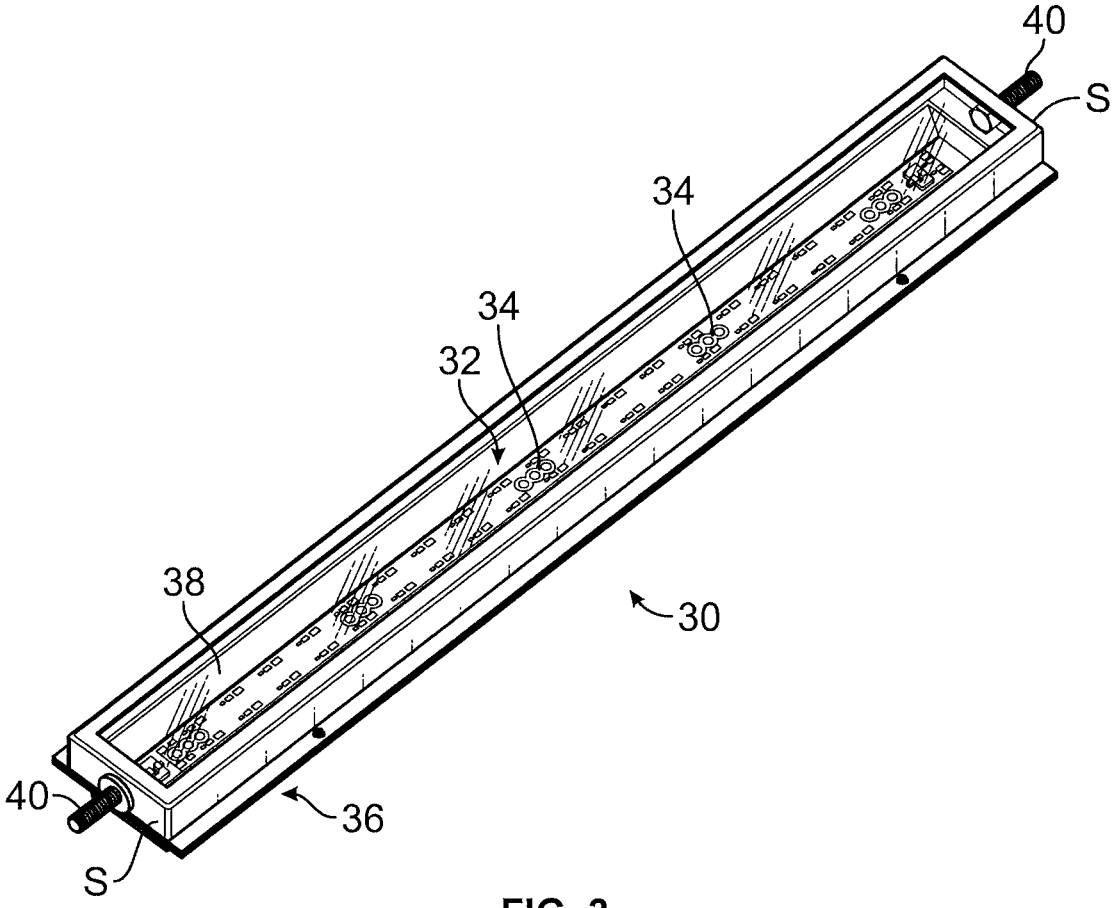
FIG. 3 is a bottom perspective view of the light box of a fixture made in accordance with the present invention.
Figure 4:
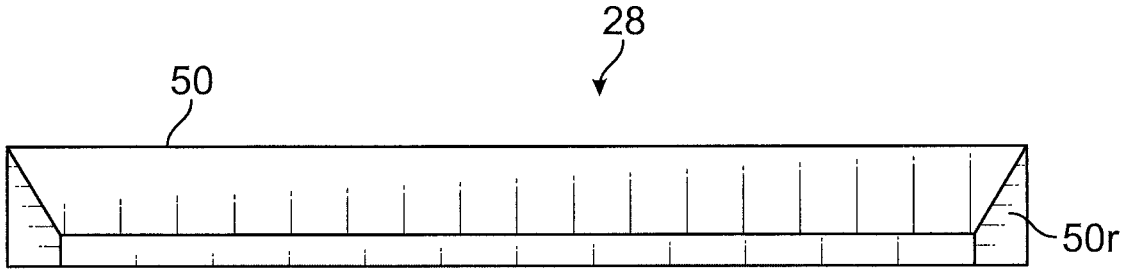
FIG. 4 is a front elevational view of a light fixture of the type used in the present invention.

FIGS. 2 and 3 show a light box, or lighting element 30 for use in a lamp 28 (FIG. 4). Light element 30 is shown comprising a lighting unit 32 having electrical light components 34, shown here as LED lights, however, as will be understood by persons having ordinary skill in the art, the light elements can be of any type of component currently known or later discovered, without departing from the novel scope of the present invention. Such light components can include fluorescent tubes, high intensity discharge (HID) elements, incandescent lights, arc lights or gas discharge lights and any other known type lighting components. Lighting element 30 further comprises a protective housing 36 a lens 38, that both can enhance and/or focus the light emitted therefrom and/or protect the components 34 therein. It will be seen that lighting element 30 further includes pivot elements 40 on each of the short sides "S" of the lighting element 30; at or adjacent to the long axis of the lighting element. It will be understood that by holding both pivot elements 40, the lighting element 30 can be rotated about its long axis. Pivot elements 40 are shown in the figures as threaded cylindrical elements or bolts, because, as will be disclosed below, lighting element 30 will be attached, in a preferred embodiment, within a housing 50 (FIG. 4) using conventional threaded fasteners 42, nuts, for security and ease of connection. It will be understood that light element 30 can be pivotably connected to housing 50 by any conventional means available, including using other means known to persons having ordinary skill in the art. The use of fasteners as shown permits the easy assembly and disassembly of the lamp as needed for assembly, attachment, installation and removal. The inclusion of a bolt 40 and a cooperative nut 42 provides the user with the ability to set the angle of the rotation of light element 30 and lock that position by tightening the nuts 42 onto bolts 40. Similarly, with the use of spacers and washers and leaving the nut and bolt connection somewhat loose, provides the user with the ability to set the angle of the light element 30, relative to the lamp unit 28 with the ability to then change the angle as needed after the light fixture 28 is installed. The nut and bolt combination, as will be understood by persons having ordinary skill in the art, can be tightened or loosened to provide the desired friction coefficient to provide the amount of movement desired by the user for a given situation.

Figure 5:
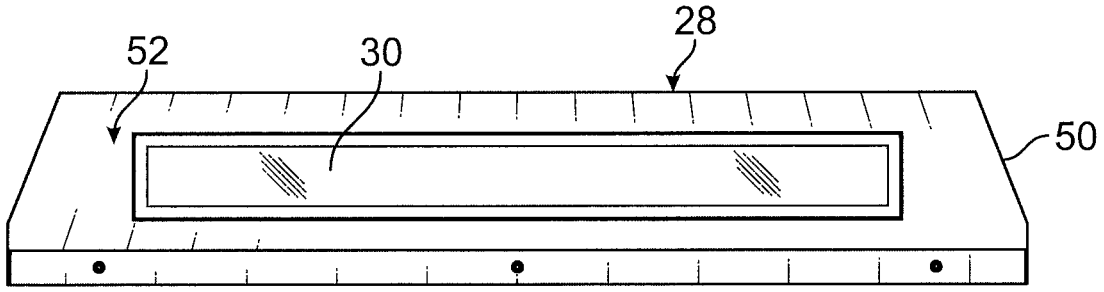
FIG. 5 is a bottom plan view of the light fixture of FIG. 4.

Referring to FIGS. 4 and 5, housing 50 is shown from the front (FIG. 4) and the bottom (FIG. 5); the bottom of the housing 50 comprises a cover element 52, which in cooperation with the housing 50 and the light element 30, provides a relatively sealed enclosure for the lamp 28. Such an enclosure allows a fixture to be better suited to outdoor placement or any placement where the risk of the encroachment of the elements might harm the fixture. It will be understood by persons having ordinary skill in the art that the fixtures of lamps, of the prior art, typically are placed and project their light to one position only. Should the light be required in a different position, the entire fixture must be moved, shimmed or otherwise adjusted so as to cause the light to project where needed.

Figure 6:
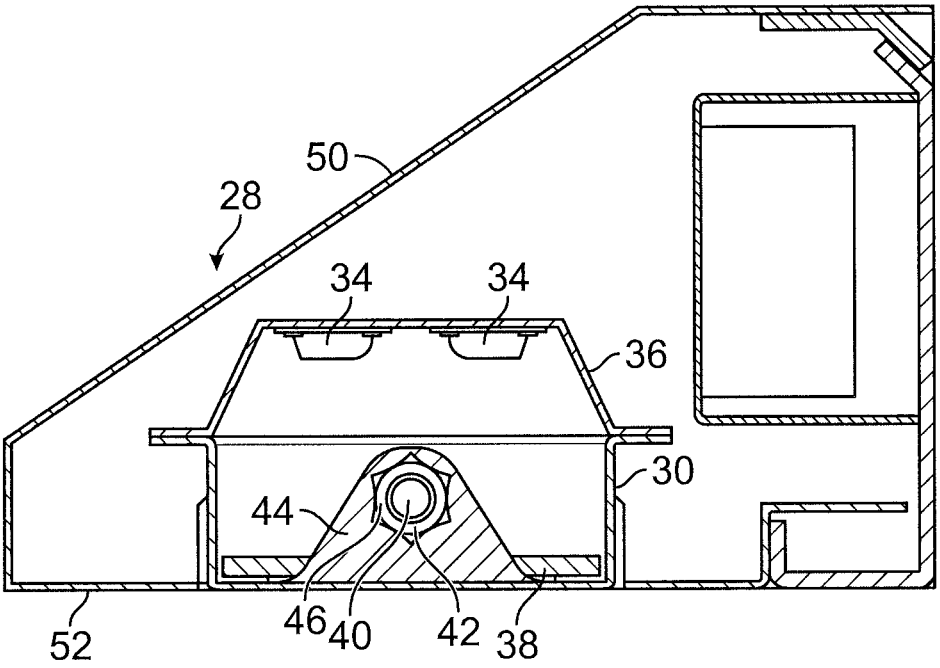
FIG. 6 is a side elevational view, partially cut away to show the interior components, of the light fixture of FIG. 4.

The lamp 28 of the present invention is more clearly shown in FIG. 6, which is a side view of the lamp 28, with a right side covering 50*r* (as shown in FIG. 4) removed to provide a view within the lamp 28. Housing 50 and cover element 52 are shown surrounding light element 30, having features as previously described. Additionally, a retaining end cap 42 has been placed onto pivot element 40, to keep light element 30 in place in lamp 28 by threading pivot element 40 through flange 44 prior to attachment to end cap 42. In the present embodiment pivot elements 40 are attached to light element 30 in any manner known to persons having ordinary skill in the art, including via threadings (as pivot element 40 in the present embodiment is a threaded cylinder) or welding. End caps 42, in the present embodiment, is at least a nut having cooperative threadings therein, which are attached to pivot elements 40 after lighting element 30 is put into place within lamp 28 and the pivot elements are threaded through openings 46 in a supportive flange 44. As more clearly shown in FIG. 7, pivot elements 40 are shown with more than one threading nuts 42 and additionally include at least a washer 46 and a spacer 48 to allow lighting element 30 to be fixed to a supportive flange 44 held within housing 50 of lamp 28 and allow lighting element 30 to pivot therewithin.

Figure 7:
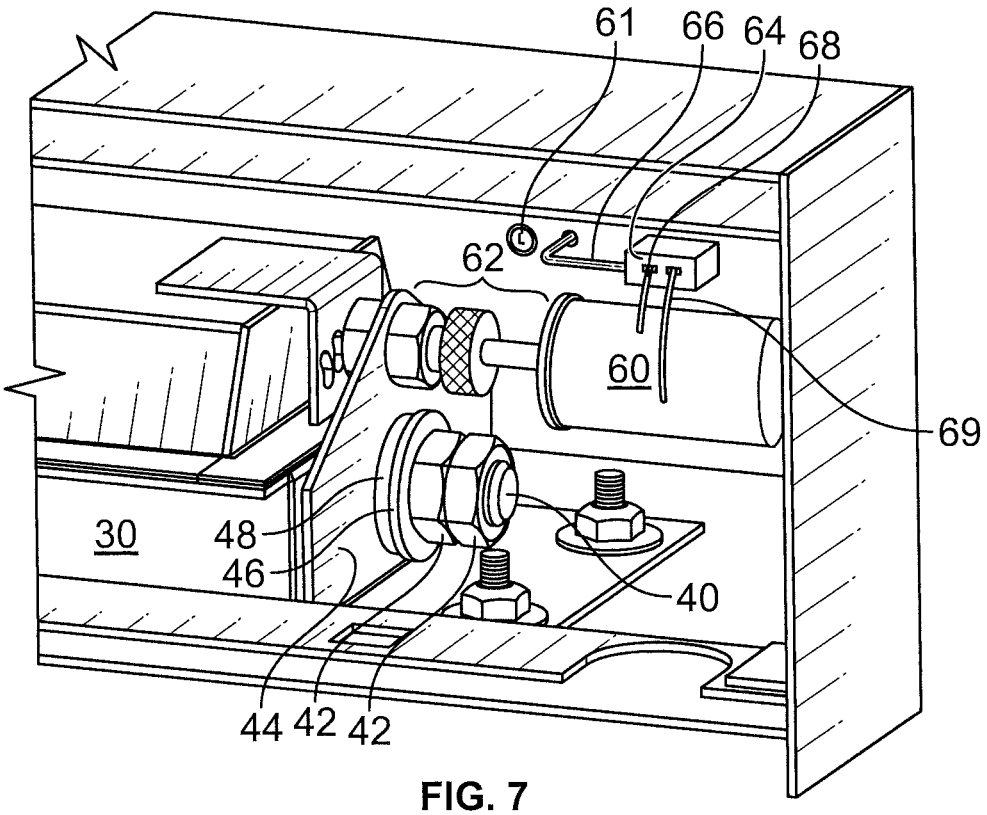
FIG. 7 is a partially cut away view of the interior of another embodiment of the light fixture of FIG. 4, having a pivoting mechanism and a means to remotely pivot the light box.

Referring now to FIG. 7, as previously noted an embodiment of the present invention is shown, however this embodiment is further improved with the addition of a motivation unit 60, with attendant motivation parts 62 (such as gears, pulleys, a transmission and other elements as known to persons having ordinary skill in the art) to permit pivoting of lighting element 30, within housing 50, from a remote location. To assist such remote operation, the unit can include a control unit 64 (which can be mechanically or computer aided controls as needed, and can comprise, among other things known to persons having ordinary skill in the art, a microprocessor, communications, tracking, memory and storage components typically found in a computer or computing unit such as is necessary for the tasks noted herein) having control and power connections 66 and communication connections 68 between the control unit 64 and the motivation unit 60 and an optional antenna 69 should wireless access be desired. Additionally, the motive unit can be combined with a timing unit 61, allowing for programming the movements of the light element 30, such that the light can be programmed to move to provide the appropriate lighting at desired times. For example, it may be desirable that the position of the light be in a different location in the early morning, pre-dawn hours, then at the post-sunset hours and this embodiment would provide the means to automatically pivot the light to the degree desired for a specific time.

It will be understood by persons having ordinary skill in the art that, concomitantly, the fixture 28 can be provided with calendar means to automatically change the position of the light based on seasons and to compensate for the rotation of the earth relative to the sun. It will be understood by persons having ordinary skill in the art that in addition to a time dependent unit, a light detecting unit can also be used to change the position of the light element 30 depending on such a unit. For example, a light detector can determine that it is presently dark out and rotate the light element 30 from a protected position to a position where light will be projected to a preselected location. As such, a full 180 degrees of rotation for the light element 30 can be made; or a smaller degree of rotation can occur, as programmed by the user, to change the position of the light from the light element 30 as darkness more completely envelops a location where lighting is desired; the rotation thereby tracking the diminishing natural light to provide light where needed.

Figure 8:
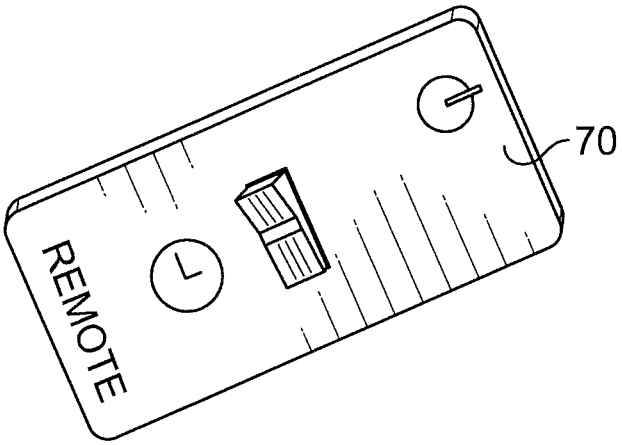
FIG. 8 is a perspective view of a remote control device.

FIG. 8 shows a remote control unit 70 that can be used to remotely pivot lighting element 30; it will be understood that remote control unit 70 can be a wired or wireless unit, as will be understood by persons having ordinary skill in the art. The remote unit can also include a timing means to be able to adjust the time at which rotation of the lighting element 30 is to be rotated. Further, the mechanism to rotate or cause the rotation of lighting element 30 can be placed elsewhere than within the lamp 28, such as on a wall adjacent to the switch that can turn on and off the lamp.

Figure 6A:
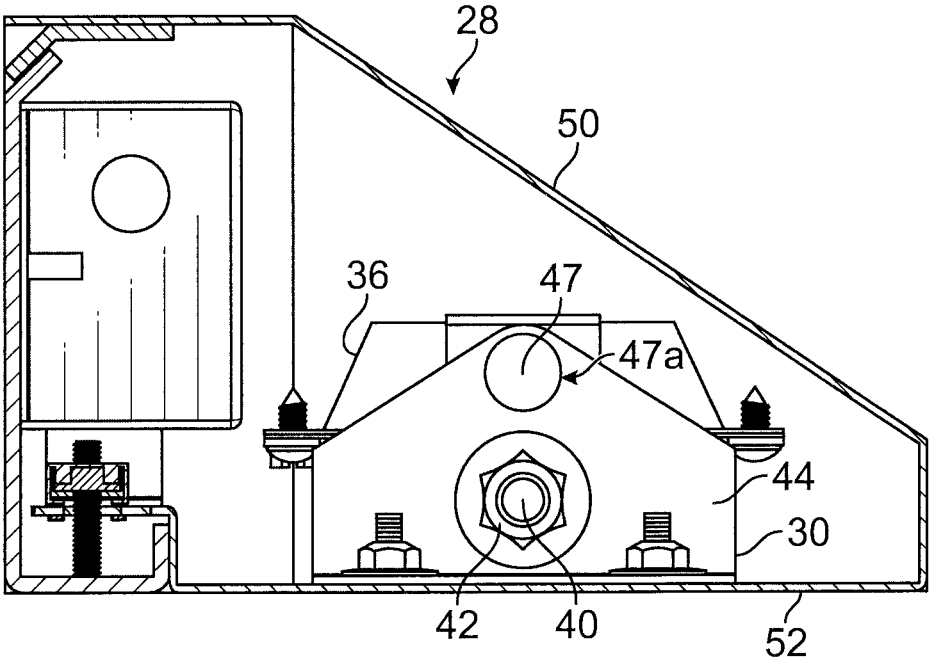
FIG. 6A is a side elevational view, partially cut away to show the interior components, of another embodiment of the light fixture of FIG. 4.
Figure 7A:
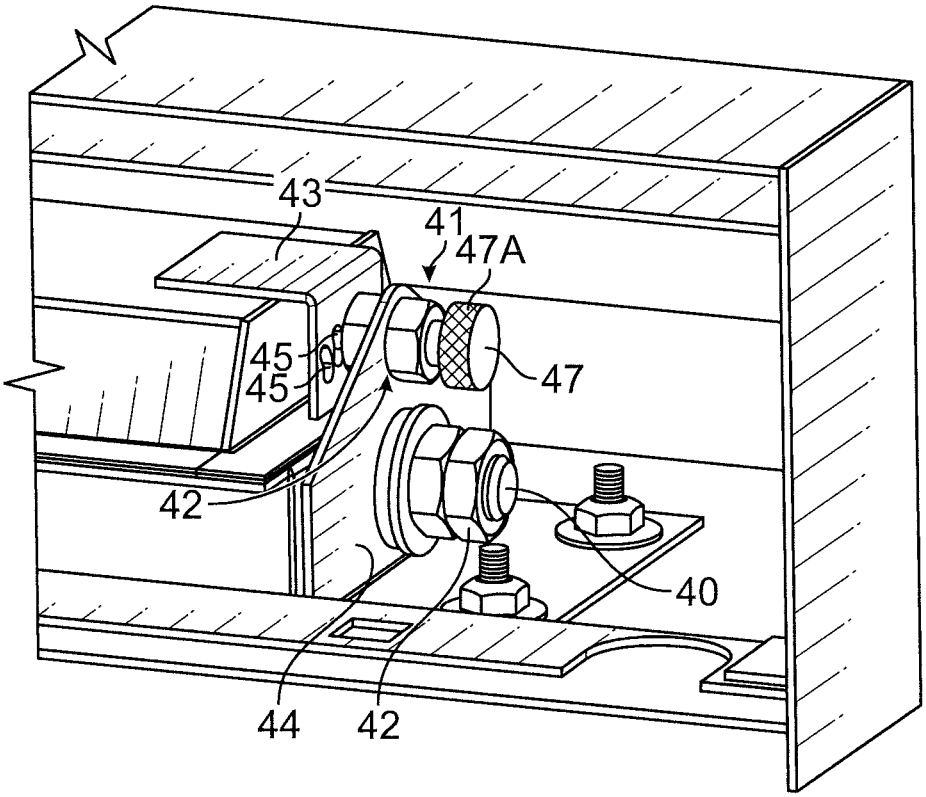
FIG. 7A is a partial cutaway view of the interior of another embodiment of the light fixture of FIG. 4, having a pivoting mechanism and a means to remotely pivot the light box.

Referring to FIGS. 6A and 7A, an embodiment of lamp 28, with a locking mechanism 41 is shown, having other components similar to and numbered like those in FIGS. 6 and 7. Locking mechanism 41 includes a flange 43 having detent openings 45 equally spaced along an arc on flange 43; it will be understood that while detent openings 45 are shown on one side of a locking knob 47 (having a grip-able surface 47*a*), detent openings, which are not shown, exist on the other side as well to provide concomitant locking positions, and also in the center of the arc to provide a neutral position for lamp unit 30. In the present example, 5 such detent openings 45 are disclosed, each comprising first a placement in the neutral position and then a pivot, right or left, of approximately one quarter of the entire pivot range of light element 30. In one embodiment, shown in FIG. 7A, the light element is permitted a range of 50 degrees, that is an arc of 25 degrees on either side of the main axis of the device, and so each detent opening provides a lock at intervals of 12.5 degrees (that is 0 degrees, 12.5 degrees and 25 degrees on either side of the axis). It will be understood that more or fewer detent openings can be placed on flange 43 to provide fewer or greater numbers of stops in which to lock the position of the lamp element 30. In some embodiments, the housing of the lamp must be removed to reach the locking mechanism 41; in other embodiments, the lamp can be rotated without being disassembled.

In the use of the locking mechanism 41, the knob 47 is pulled away from the flange 43 (in FIG. 6A, the pull would be to the right), the lamp unit 30 is then rotated to a desired position and the knob 47 is pushed back into the flange, to rest, at the distal end of knob 47, in one of the detent openings 45. It will be understood that locking mechanism 41 can be of various types that allow knob 47 to be retracted and then replaced to hold the lamp unit 30 in position. In a preferred embodiment a spring, such as a coil spring or other spring (of any type that will provide the necessary force to pull knob 47 into a detent opening 45 and keep it in position), is used to pull knob 47 into one of the detent openings 45 in flange 43. When a change in position is desired, knob 47 is pulled against the force of a spring (not shown) and once pulled away from the flange, the lamp element 30 can be rotated along the arc of rotation and when released, the distal end of knob 47 (not shown) then rests in another one of the other detent openings 45, locking the lamp unit 30 in a desired position. In another embodiment, knob 47 has a threaded end and is drawn into flange 43 using corresponding threadings placed in each of the various detent openings 45; when a position change is desired, knob 47 is unscrewed from the detent opening, rotated and then threaded into another detent opening 45, locking lamp unit 30 in a desired position. It will be understood by persons having ordinary skill in the art that any manner of releasing and locking mechanism 41 can be used to place the lamp in a desired position without departing from the novel scope of the present invention.

Figure 9A:
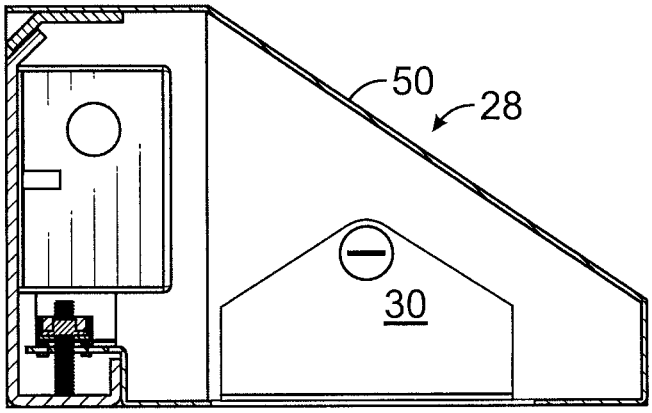
FIGS. 9A, 9B and 9C are side elevational views, partially cut away to show the interior components, of the light fixture of FIG. 8 in different pivoted positions.
Figure 9B:
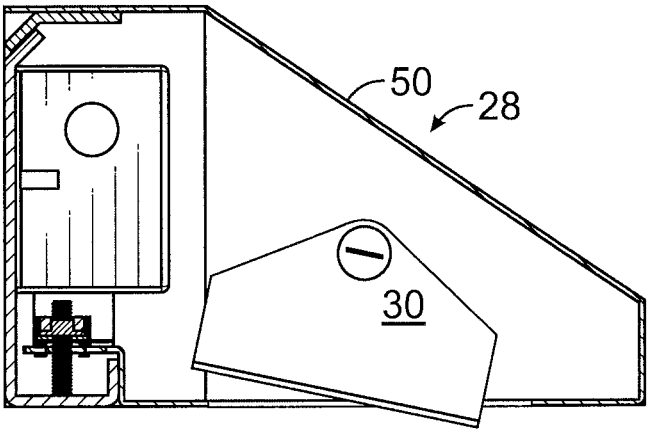
Figure 9C:
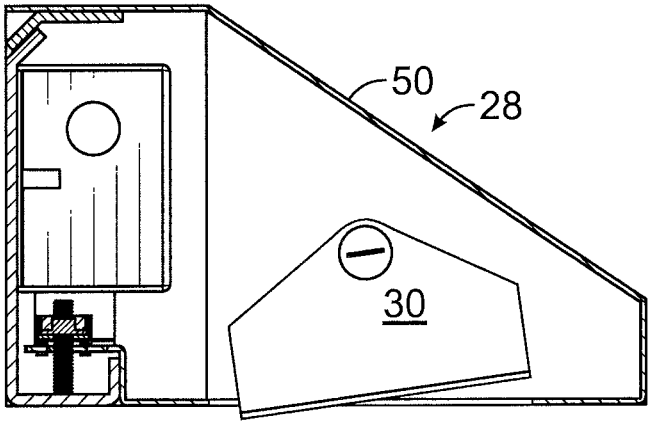
Figure 10A:
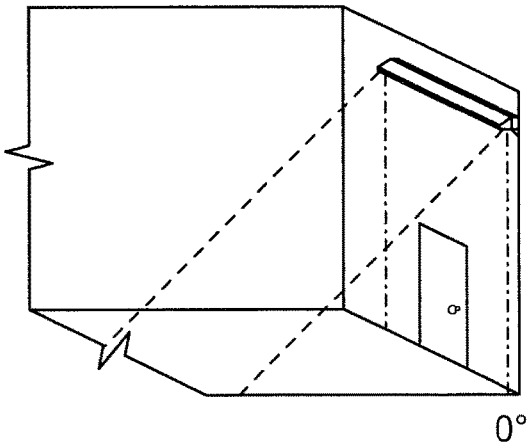
FIGS. 10 (10A-10E) are a series of schematic representation of various position to which the light emanating from a light fixture of the present invention can be aimed, using the elements of the present invention.
Figure 10B:
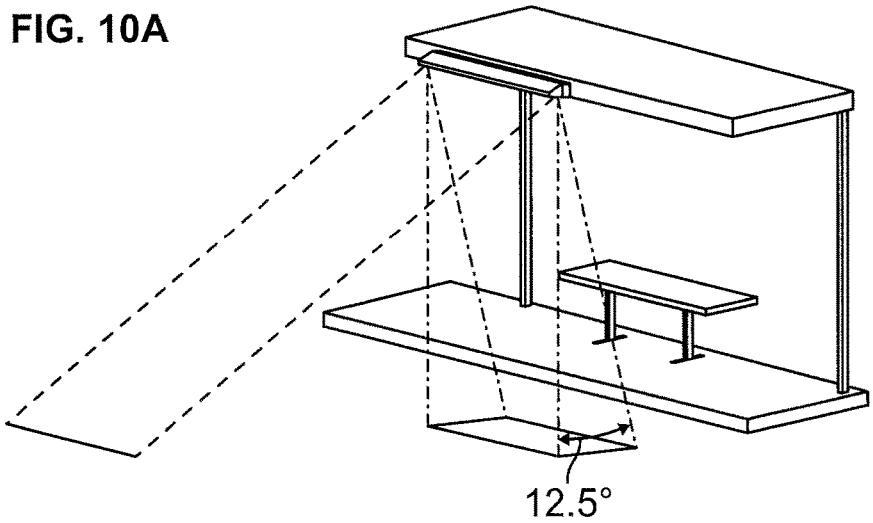
Figure 10C:
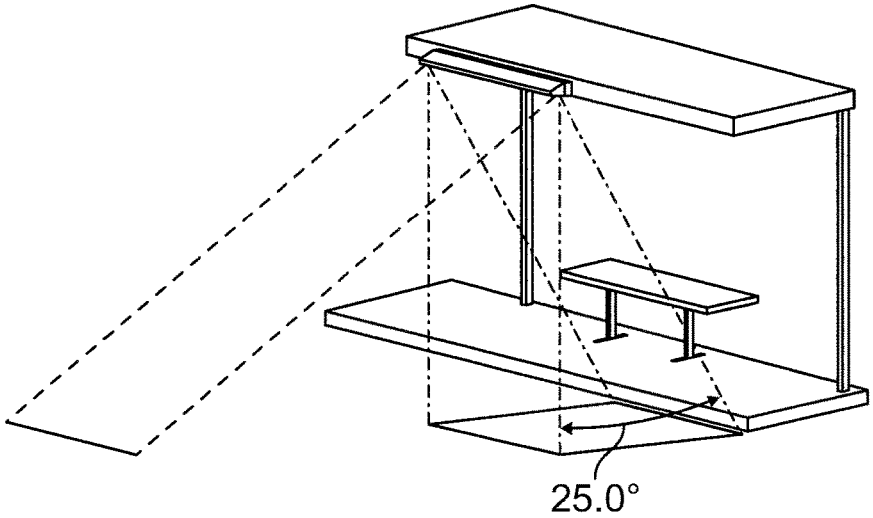
Figure 10D:
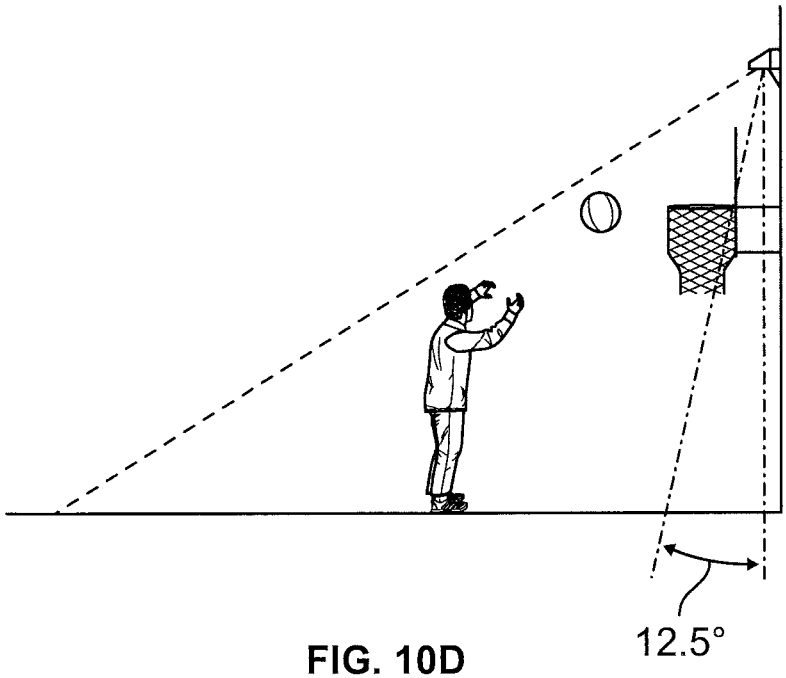
Figure 10E:
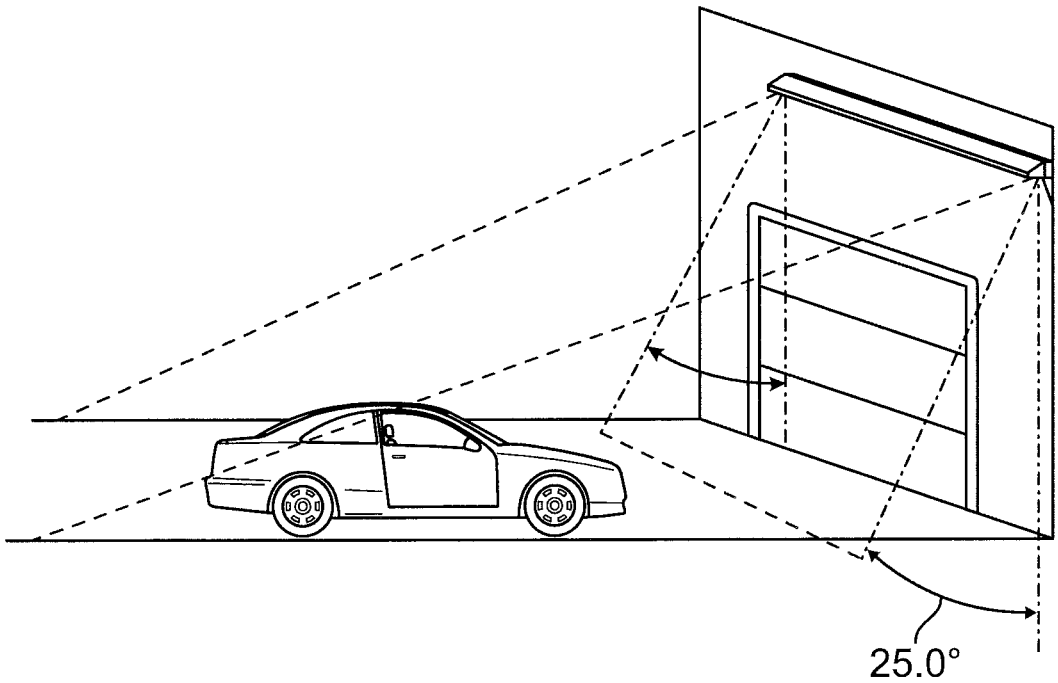

Referring now to FIG. 9, three views of pivot locations of lighting element 30 are shown to give a realistic view of the angles to which the light element can be pivoted to direct light as the user desires, without moving housing 50 in any way. Referring now to FIG. 10 various scenarios for original placement and then the pivoting the light unit are shown to demonstrate the flexibility of the present invention in providing light where needed without having to remove and replace the or otherwise physically move fixture 50 of lamp 28 to better light a surface. FIG. 10A shows an exterior door of a building lighted from the base of the door to a point away from the door, providing adequate lighting for the situation. FIGS. 10B and 10C show a bus stop shelter situation showing in two different lighting situations, FIG. 10B shows the initial set up as the light is placed so as to illuminate the area immediately in front of the shelter and then the second situation (FIG. 10C) showing the light being pivoted so as illuminate a portion within the shelter as well. FIG. 10D shows a situations wherein a basketball court can be illuminated to an outside perimeter or can be illuminated to show a position behind the net, so as to better show an out of bounds area. FIG. 10E shows a driveway situation allowing the user to either illuminate an area next to the building wall or to better illuminate an area further away from the building wall, as desired. It will be seen that pivot points of 12.5 degrees and 25 degrees are shown to correspond with the embodiment of the device shown in FIG. 7A.

Although an illustrative embodiment of the invention has been shown and described, it is to be understood that various modifications and substitutions may be made by those skilled in the art without departing from the novel spirit and scope of the invention.

What is claimed is:

1. A linear light fixture for providing secure targeted lighting, comprising:

a protective housing for fixedly mounting the light fixture, the housing defining an axis between a right side panel and a left side panel of the housing;

a light element pivotably attached within the housing, at least parallel to the axis defined therein, such that the light element rests within the housings and is protected thereby, so that light projects from the fixture when the light is on; wherein, the light element is pivotable within a range relative to the axis of the housing such that the light element can be aimed, in that range, as desired to direct the light and can subsequently be aimed to direct the light elsewhere within the range, and the light fixture including a central locking pin and two or more detent opening, the two or more detent openings being spaced along an arc shape corresponding with the pivoting of the light element, the locking pin and two or more detent openings cooperating so that the locking pin can secure the angle of the light element along the arc after the light element is pivoted to a desired position and the locking pin is placed in one of the two or more detent openings, thereby locking the light element at that location.

2. The light fixture of claim 1, wherein the light element is LED lamps.

3. The light fixture of claim 1, wherein the light element is pivoted on threaded bolts placed at an axis of the light element.

4. The light fixture of claim 3, wherein the threaded bolts are capped with spacing means and cooperatively threaded nuts to allow the light element to rotate about the axis of the housing and be locked, by tightening the threaded nuts, at a desired position.

5. The light fixture of claim 1, wherein the fixture includes a motive means comprising at least a motor and a transmission to control the pivoting of the light element.

6. The light fixture of claim 5, including a remote control to activate and control the motive means.

7. The light fixture of claim 5, having light projection aiming means, including one or more of a timer, programming and a solar detector, to cause the motive means to pivot the light element in response to the aiming means.

8. The light fixture of claim 1, wherein the light element is provided with a protective lens to protect the interior of the light fixture and focus light emitted from the light element.

9. The lighting fixture of claim 1, wherein the lighting fixture is sealed for exterior use.

10. A light fixture for providing secure targeted lighting, comprising:

a protective housing for mounting on a structure, the housing comprising a generally rectangular top a front side panel, a left side panel and a right side panel, each depending therefrom, the bottom and back of the housing being open, the housing defining an axis extending between the right side panel and the left side panel of the housing;

a mounting plate, having a front side and a rear side, for attachment at its rear side to a structure and at its front side to the housing;

a cover element, for attachment to the housing, the cover element having an opening therewithin, the opening being framed within the cover element;

a single light element pivotably attached within the housing, at least parallel to the axis defined therein, such that the light element rests, within the housing, so that light emerges through the opening in the cover element when the light is on, the light element being pivotable relative to the axis of the housing in a range of about 50 degrees, in increments of desirable intermittent and set degrees, such that the light element can be aimed, in that range, as desired to direct the light and, can subsequently be aimed to direct the light elsewhere within the range.

11. The light fixture of claim 10, wherein the light element is pivoted on threaded bolts placed at an axis of the light fixture.

12. The light fixture of claim 11, wherein the threaded bolts are capped with spacing means and cooperatively threaded nuts to allow the light element to rotate about the axis of the housing and be locked, by tightening the threaded nuts, in a desired position.

13. The light fixture of claim 12, wherein a locking means is provided for easy unlocking the light element from one position and quickly locking it into another position after the light element is pivoted to a desired position, so as to lock the light element at that, location.

14. The light fixture of claim 10, wherein the degree of rotation of the light element is 180 degrees, such that the light element can be pivoted within a projection range and subsequently rotated into an interior of the housing to protect the fixture from damage.

15. The light fixture of claim 10, wherein the fixture includes a motive means comprising at least a motor and a transmission to remotely control the pivoting of the light element.

16. The light fixture of claim 15, having means, including one or more of a timer, programming and a solar detector, to cause the motive means to pivot the light element.

17. The light fixture of claim 10, wherein the light element is provided with a protective lens to protect the interior of the light fixture and focus light emitted from the light element.

18. The lighting fixture of claim 10, wherein the lighting fixture is sealed for exterior use.

* * * * *